US006634668B2

(12) United States Patent
Urffer, III et al.

(10) Patent No.: US 6,634,668 B2
(45) Date of Patent: Oct. 21, 2003

(54) COLLAPSIBLE DISPLAY CART

(76) Inventors: Russel Urffer, III, 15 Hillcrest Dr., Sellersville, PA (US) 18960; Richard N. Gallagher, 620 E. Reliance Rd., Telford, PA (US) 18969

( * ) Notice: Subject to any disclaimer, the term of this patent is extended or adjusted under 35 U.S.C. 154(b) by 76 days.

(21) Appl. No.: 09/922,071

(22) Filed: Aug. 6, 2001

(65) Prior Publication Data

US 2003/0025302 A1 Feb. 6, 2003

(51) Int. Cl.[7] ..... A47B 46/00; A47B 88/00; B60R 3/02

(52) U.S. Cl. ..... 280/651; 280/47.35; 296/21; 312/249.11; 312/310; 312/312

(58) Field of Search ..... 312/284, 287, 312/312, 310, 249.8, 249.11, 295; 280/651, 652, 47.35; 108/147, 102; 296/21, 26.05, 173, 26.13, 170

(56) References Cited

U.S. PATENT DOCUMENTS 1,752,699 A * 4/1930 Ross ..... 211/134
2,518,764 A * 8/1950 Dunlap ..... 312/405
2,575,725 A * 11/1951 McKay ..... 312/312
2,614,020 A * 10/1952 Collins ..... 312/312
2,812,104 A * 11/1957 Larsen ..... 312/306
2,861,857 A * 11/1958 Lee et al. ..... 312/312
3,078,133 A * 2/1963 Schauer ..... 312/321.5
3,288,545 A * 11/1966 Benne ..... 312/193
3,388,943 A * 6/1968 Clement ..... 296/21
3,516,708 A * 6/1970 Cox ..... 296/170
3,749,439 A * 7/1973 Ferguson ..... 296/26.05
4,572,598 A * 2/1986 Moore, Jr. ..... 312/284
5,048,857 A * 9/1991 Stevens ..... 280/651
5,129,611 A * 7/1992 Grover et al. ..... 248/688
5,207,723 A * 5/1993 Newby, Sr. ..... 312/249.11
5,401,089 A * 3/1995 Inagaki et al. ..... 312/7.2
5,769,485 A * 6/1998 Bontrager et al. ..... 296/171
5,823,368 A * 10/1998 Burke et al. ..... 211/175
6,336,692 B1 * 1/2002 Snyder ..... 312/312
2001/0030446 A1 * 10/2001 Lambright ..... 296/156
2002/0079788 A1 * 6/2002 Canedy et al. ..... 312/114
2002/0084662 A1 * 7/2002 Davis et al. ..... 296/26.05

* cited by examiner

*Primary Examiner*—Paul N. Dickson
*Assistant Examiner*—Laura B. Rosenberg
(74) *Attorney, Agent, or Firm*—Zachary T. Wobensmith, III

(57) ABSTRACT

A collapsible display cart for storing, transporting and displaying merchandise which has a base with shelves for holding merchandise, which can be raised and extended, at least one pair of wheels for moving the cart and a canopy for covering the base in closed condition.

6 Claims, 10 Drawing Sheets

10
57
58
59
30
29
31
52
45
27
49
51
50
53
54
76
20
77
75
18
11
14
12
12A
14A
43
42
41

COLLAPSIBLE DISPLAY CART

BACKGROUND OF THE INVENTION

1. Field of the Invention

This invention relates to a collapsible portable display cart of the type which has a base for storing merchandise on shelves, which can be raised to permit shelves to be extended to display merchandise, and has a top canopy which covers the base for storage, and is raised with the shelves to permit access to the merchandise.

2. Description of the Prior Art

Carts for storing, transporting and displaying merchandise are common and can be seen in many locations such as airport terminals and shopping malls. The typical cart is of rectangular configuration, may have a base with two sets of wheels, and open sides with a fixed overhead canopy, with the merchandise usually stacked in the center of the cart. Such carts do not provide ideal or efficient display of merchandise, are difficult to secure, take up a large amount of space for the quantity of merchandise displayed, do not provide for adequate storage of merchandise, and suffer from other shortcomings.

The collapsible display cart of the invention does not suffer from prior art problems and provides many positive advantages.

SUMMARY OF THE INVENTION

It has now been found that a collapsible, portable, display cart can be obtained, which provides for optimum merchandise display, with a plurality of shelves for merchandise display and with a canopy that can be raised for display, and lowered for secure storage or transport of the merchandise.

The principal object of the invention is to provide a collapsible, portable, display cart for displaying and storing a variety of merchandise.

A further object of the invention is to provide a collapsible, portable, display cart that provides for secure storage and transport of merchandise.

A further object of the invention is to provide a collapsible, portable, display cart that has a plurality of shelves that can be raised and lowered, and extended to display merchandise.

A further object of the invention is to provide a collapsible, portable, display cart that is easy to use.

A further object of the invention is to provide a collapsible, portable, display cart that is simple to construct, is durable and enjoys a long service life.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
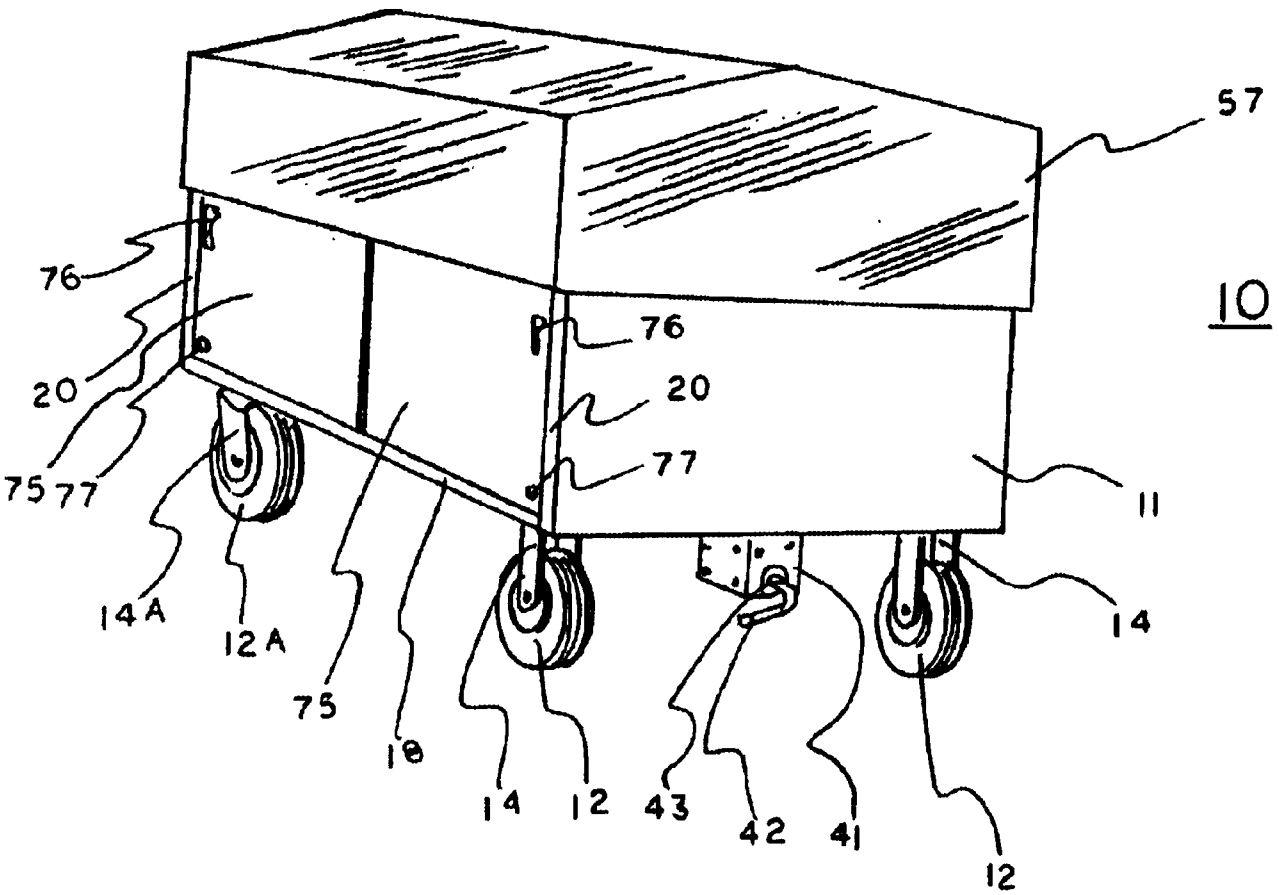
FIG. 1 is a perspective view of the collapsible, portable, display cart of the invention in condition for merchandise storage or transport.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Referring now more particularly to the drawings and FIGS. 1–3 and 6, 7, a collapsible display cart 10 is therein illustrated. The cart 10 includes a base 11, of box like rectangular configuration, and open at the top, which has a pair of pneumatic tires 12 carried in swivel brackets 14, which are mounted to a metallic base panel 15 at the front of base 11.

A pair of pneumatic tires 12A are provided carried in stationary brackets 14A, which are also mounted to the panel 15 at the rear of base 11.

The base panel 15 is secured to a metal base frame 16, which is of tubular construction, and has end members 17, with side members 18 connected thereto. The end members 17 have vertically extending members 20 connected thereto, with upper side members 21 extending between and connecting the vertical members 20.

Spanning the vertical members 20 at each end are end panels 25, which are secured to the members 20 in any preferred manner such as by welding.

Figure 4:
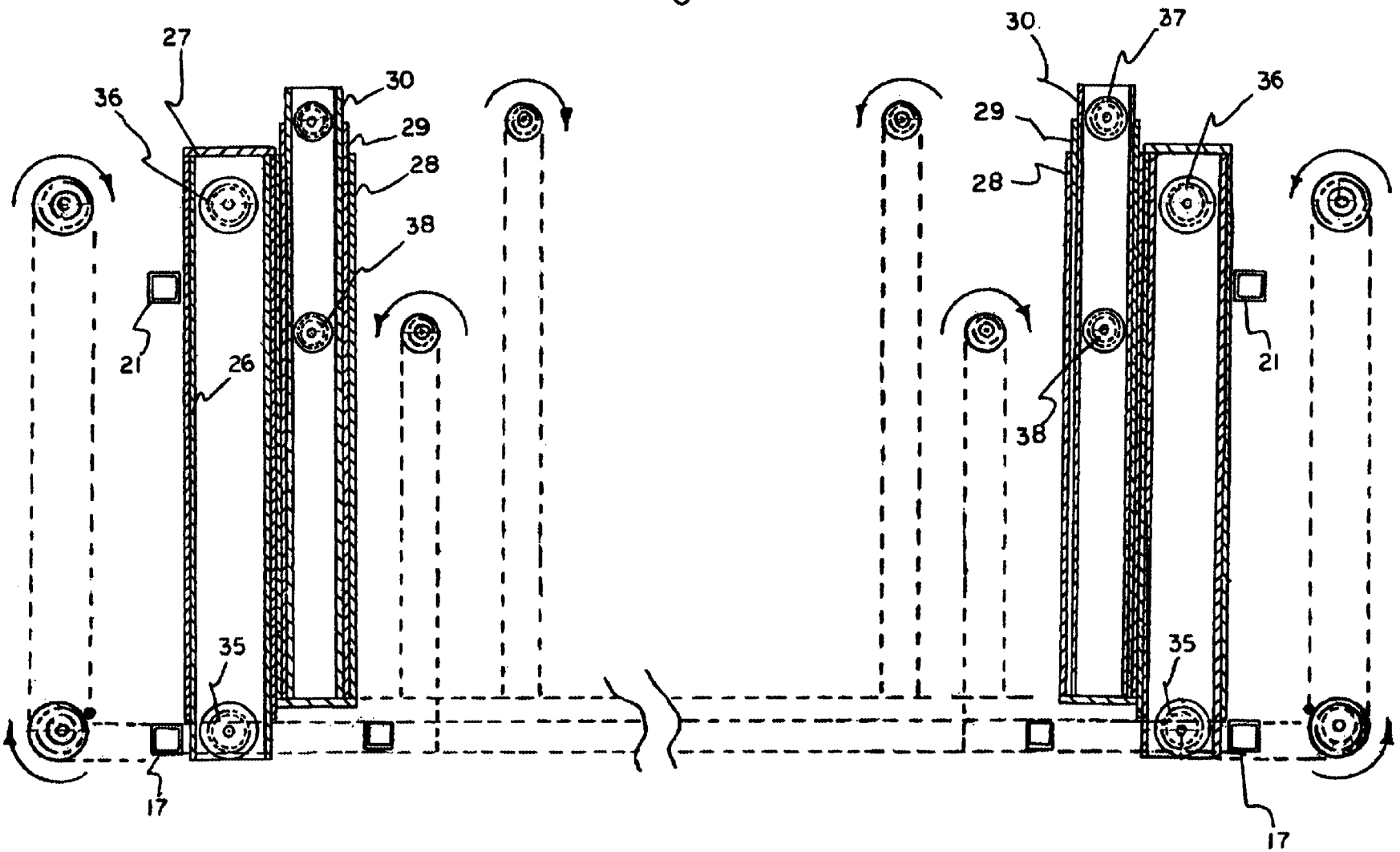
FIG. 4 is a schematic view of the operating mechanism of the cart of FIG. 1 in retracted, or closed position.
Figure 5:
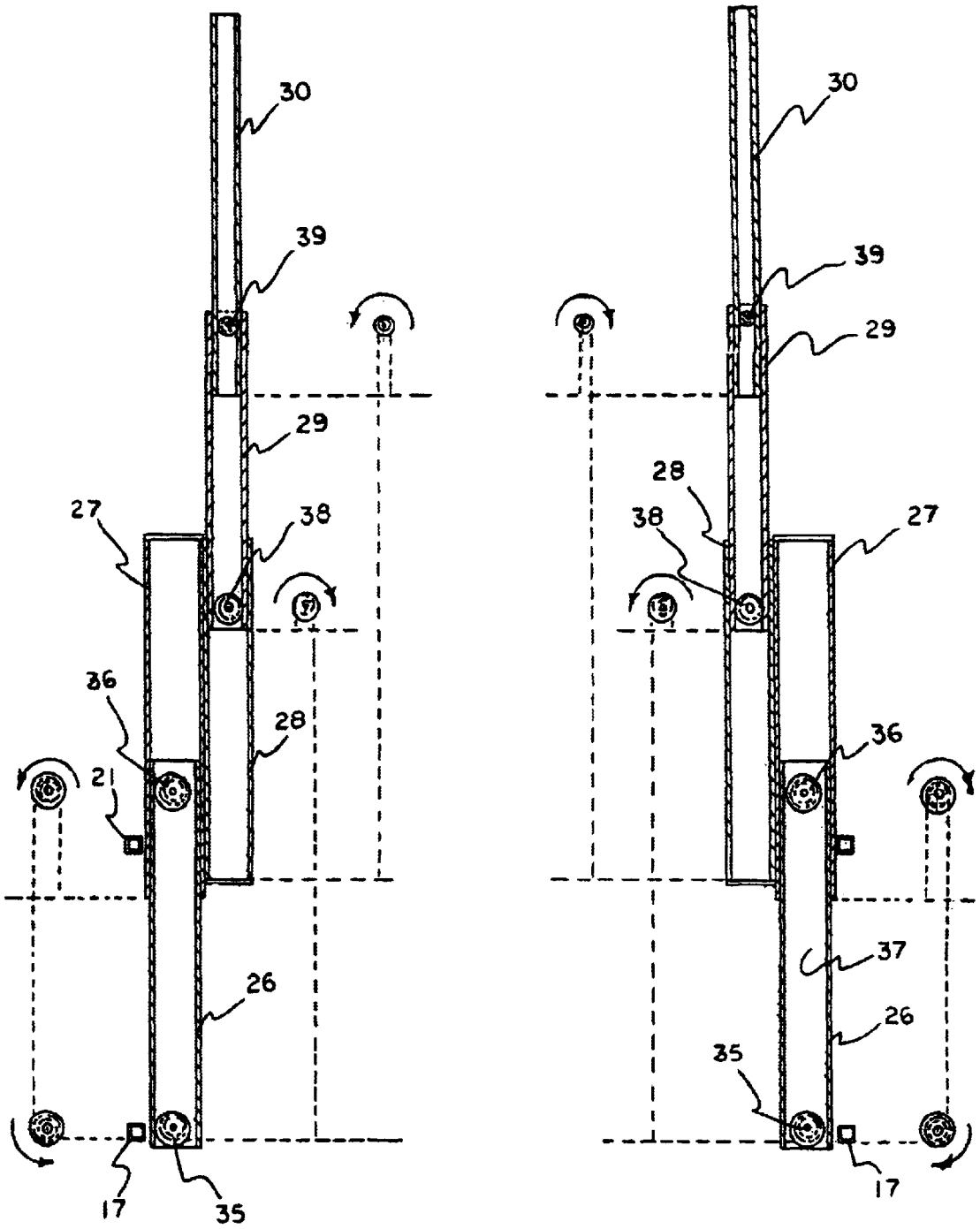
FIG. 5 is a view similar to FIG. 4 but with the operating mechanism in extended position.
Figure 6:
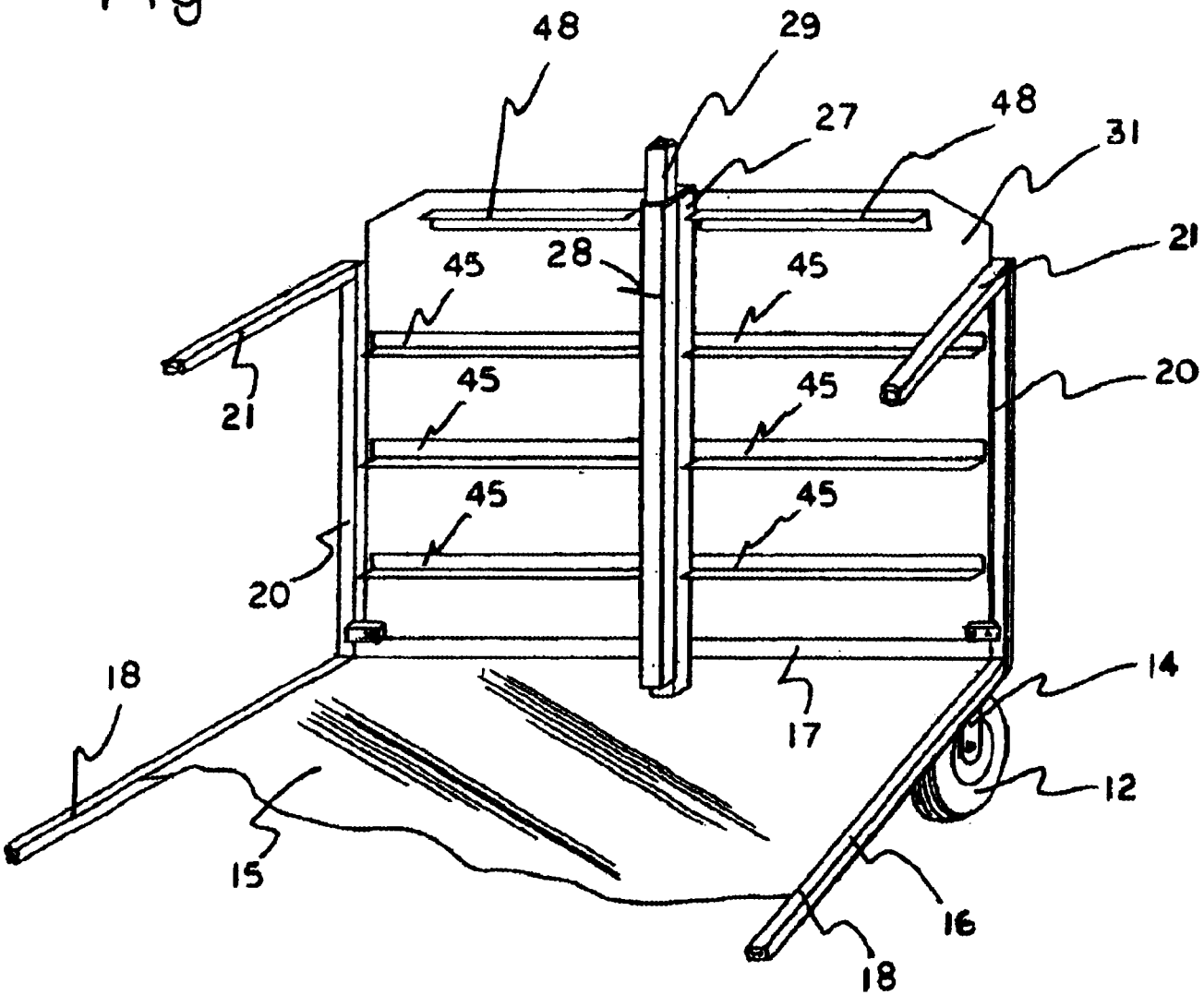
FIG. 6 is a fragmentary perspective view of a portion of the cart in retracted or closed position.
Figure 7:
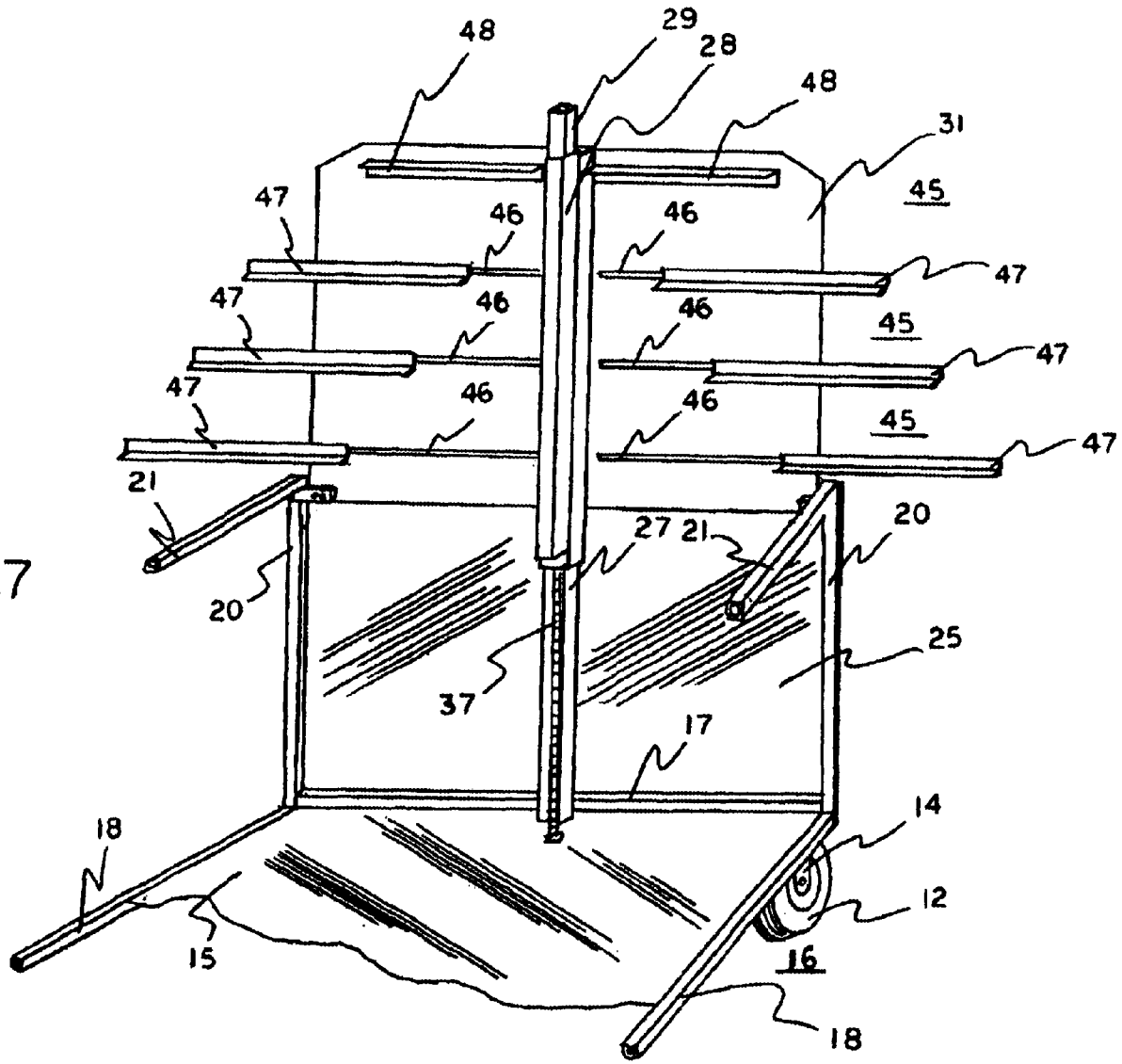
FIG. 7 is a view similar to FIG. 6 showing a portion of the cart in open condition.

Referring additionally to FIGS. 4 and 5, the end panels 25 each have a vertical channel member 26 secured thereto, and to the end members 17, with a second vertical channel member 27 engaged therewith, and a third vertical member 28 secured to the second member 27.

A fourth channel member 29 is carried in the third channel member 28, and a fifth channel member 30 is carried in the fourth channel member 29.

The second channel members 27 are secured to drawer slide panels 31, which are at each end of the cart 10, inside vertical members 20, and end panels 25.

The vertical channel members, 27, 28 and 29 are extended and retracted in relation to channel member 26 by a series of sprockets mounted thereto which are connected by an endless chain, to be described.

As shown in FIGS. 4 and 5, the channel members 26 each have a sprocket 35 rotatably mounted therein, connected to a sprocket 36 by a chainloop 37, which is connected to a sprocket 38 rotatably mounted on channel member 29, and a sprocket 39 rotatably mounted on channel member 30.

The chain 37 is engaged with a cable 62. A gear box 41, is provided which is preferably of 40:1 reduction, which box is carried on the front of cart 10 and on the bottom of base panel 15. The box 41 has an arm 42 extending therefrom, connected to a torque limiter 43 of well known type which is connected to a shaft 67 for rotation of the gear box mechanism (to be described) to move chain 37 for rotation of sprockets 35, 36, 38, and 39 to extend and retract channel members 27, 28, 29 and 30, to be described. The torque limiter prevents overwinding of cable 62.

Figure 8:
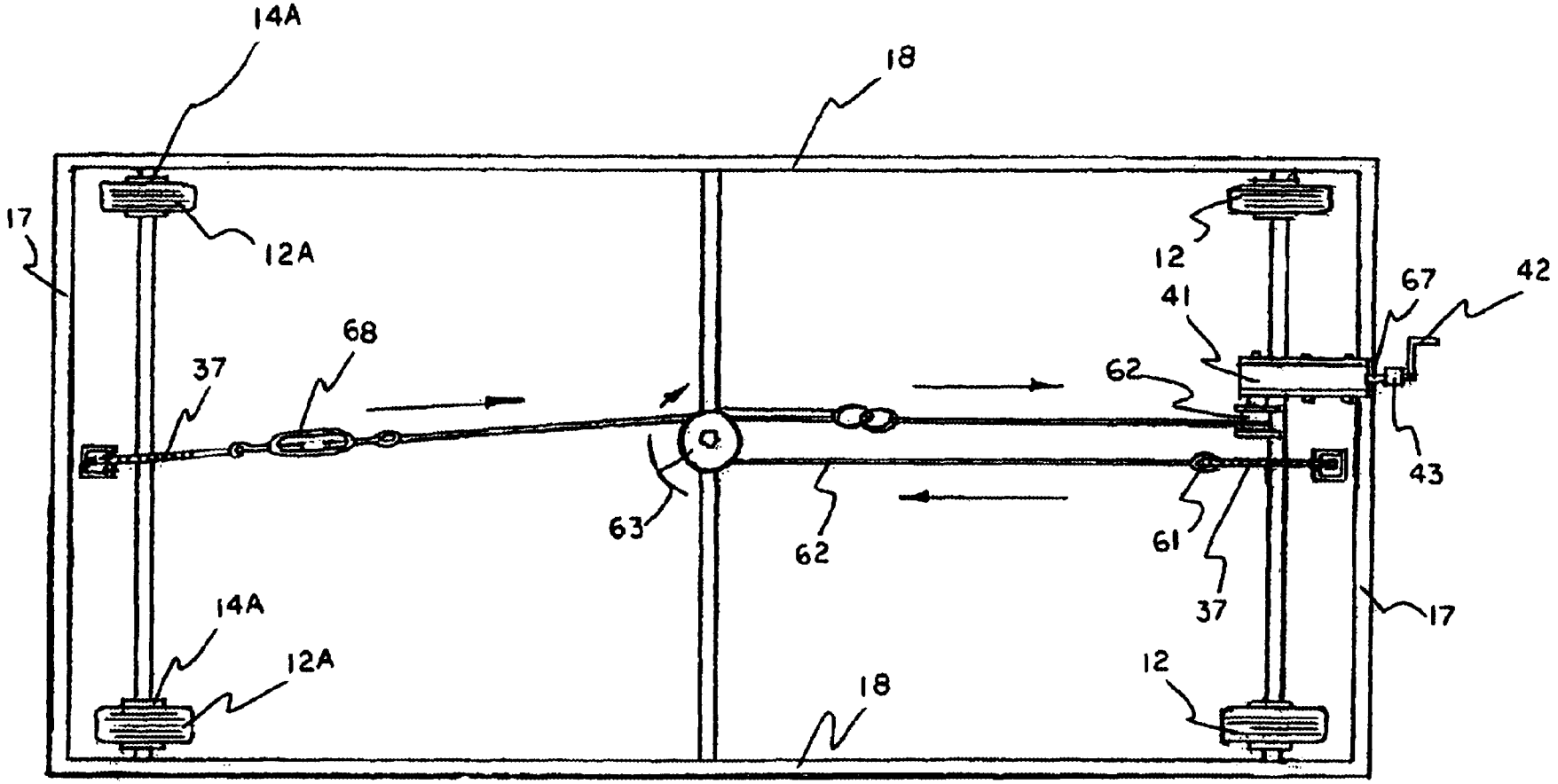
FIG. 8 is a bottom view of the cart.
Figure 9:
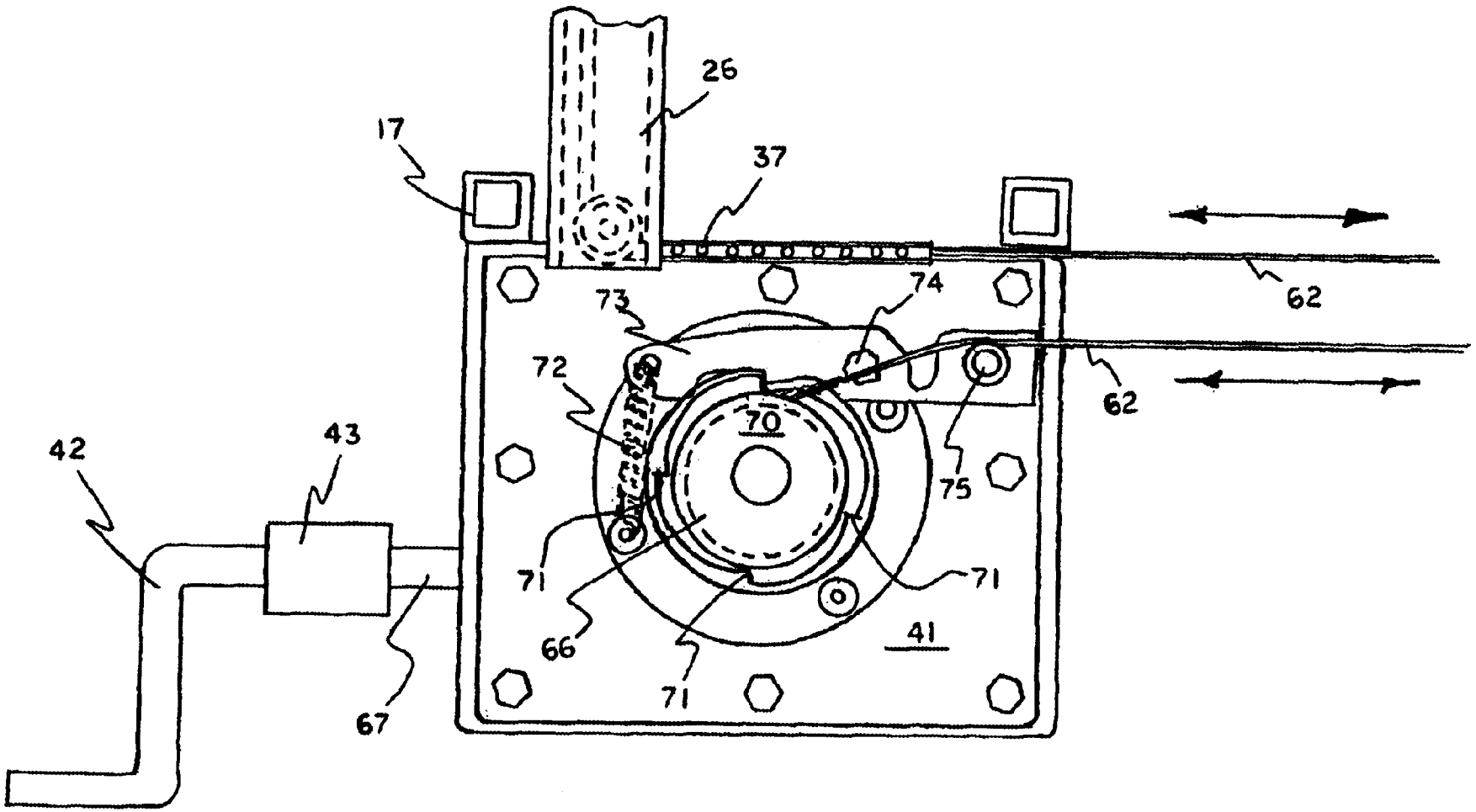
FIG. 9 is a side elevational view of the locking/unlocking chain mechanism in position to move to open position.
Figure 10:
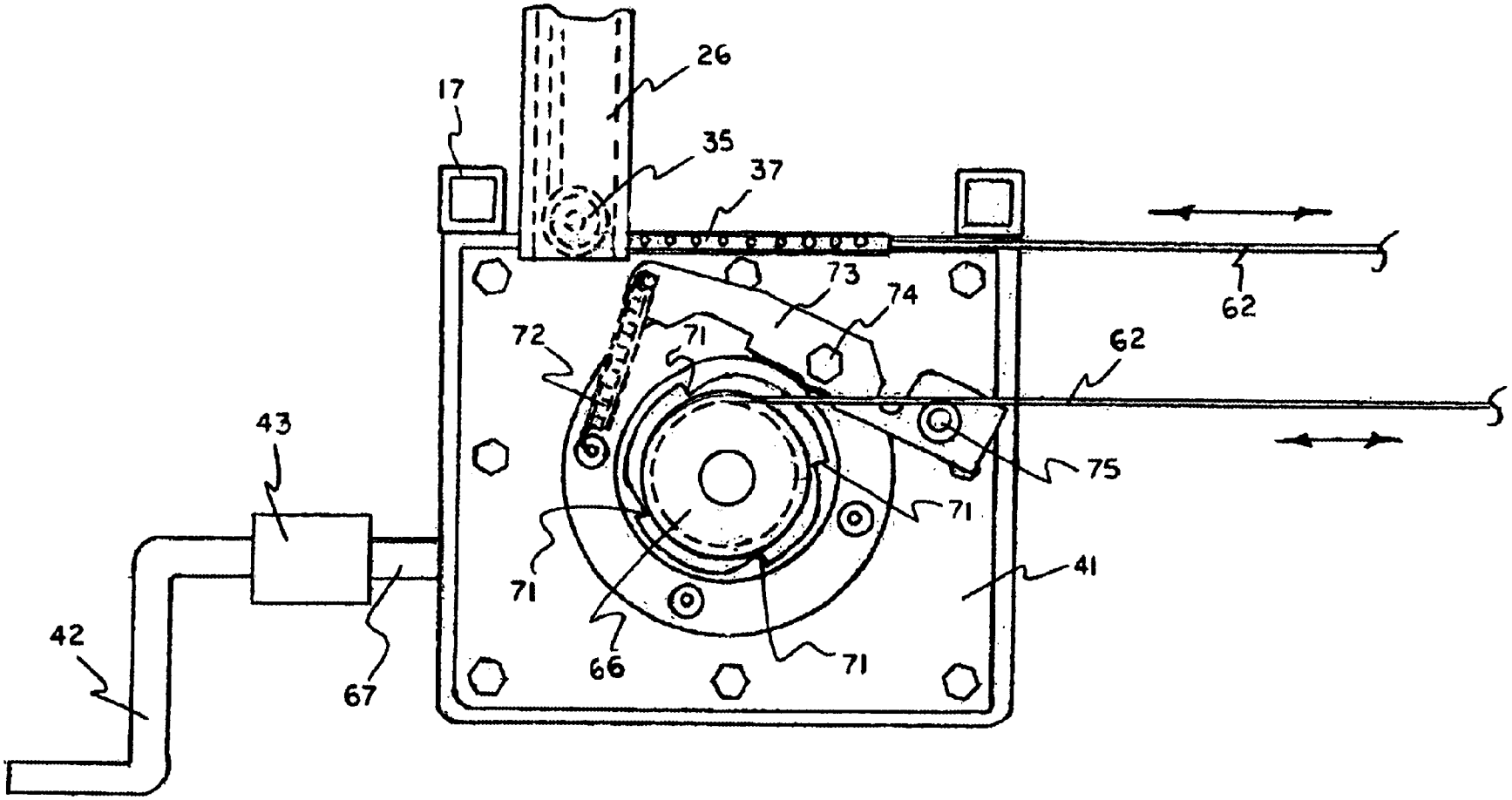
FIG. 10 is a view similar to FIG. 9 with the chain mechanism in position to move to closed position.

Referring additionally to FIGS. 8–10 the chain 37 is shown coming out of fixed channel 26 and extends to a link 61 of cable 62, which extends over a center spool 63, which is rotatably mounted to base frame 16. From spool 60 cable 62 extends to a spool 66 carried on the shaft 67 of gear box 41.

The cable 62 is also connected by a turnbuckle 68 to a chain 37, which extends into a channel 26 at the rear of cart 10.

The spool 66 has a control assembly 70 connected thereto to control the direction of rotation of spool 66, and the consequent raising, lowering of the drawer slide panels 31, to be described.

The directional control assembly 70 includes locking cogs 71, a tension spring 72, connected to a locking dog 73, which is rotatably mounted by pin 74 to box 41. The locking dog 73 has a shoulder stud 75, which is engaged by cable 62, as shown in FIG. 9. When arm 42 is rotated counter clockwise to raise the drawers and canopy assembly, the tension of the cable 62 across shoulder stud 75 cause dog 73 to disengage from cog 71. As long as there is tension on cable 62 the cable spool 66 is free to rotate in either direction. The mechanism is designed to cause the dog 73 to engage if the drawer/canopy assembly meets an obstruction when being lowered (such as a drawer being left out). When the drawer/canopy assembly meets an obstruction or reaches the bottom of its intended travel, the cable 62 will start to become slack as it is no longer lifting any weight. When cable 62 becomes slack, it allows tension spring 72 to pull down on the dog 73, causing it to engage cog 71. This stops continued clockwise rotation of spool 66 causing the torque limiter 43 to slip and preventing operation beyond the design limits of the cart.

As shown in FIG. arm 42 is rotated clockwise to lower the drawer/canopy assembly into base 11.

The slide panels 31 each have a plurality of drawer slides 45 attached to each side of member 27, and consisting of a fixed member 46, and a slidable member 47. The slide panels 31 have a pair of stationary brackets 48, which support fixed drawers 49, which extend end to end between panels 31 with bottoms 50, and open curb members 51 along the front and rear to restrain merchandise (not shown) carried on the drawers 49.

The drawer slides 45 have drawers 52 attached thereto, which extend end to end between slide panels 31, and movable in and out on slides 45.

The drawers 52 have bottoms 53, and open curb members 54 along the front and rear edge of the drawers, to restrain merchandise (not shown) carried on the drawers 52.

Figure 2:
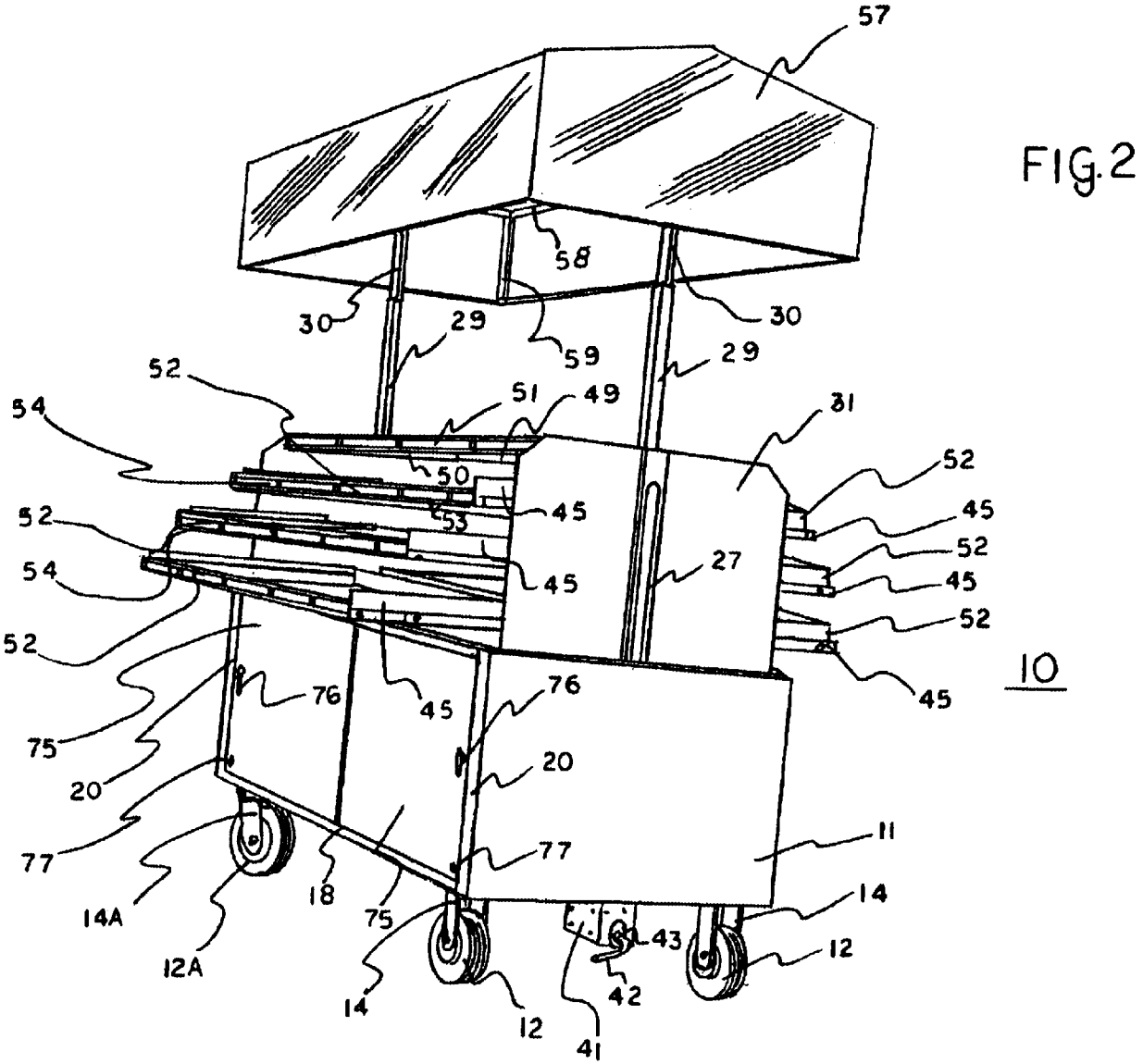
FIG. 2 is a perspective view of the cart of FIG. 1 in the merchandise display condition.
Figure 3:
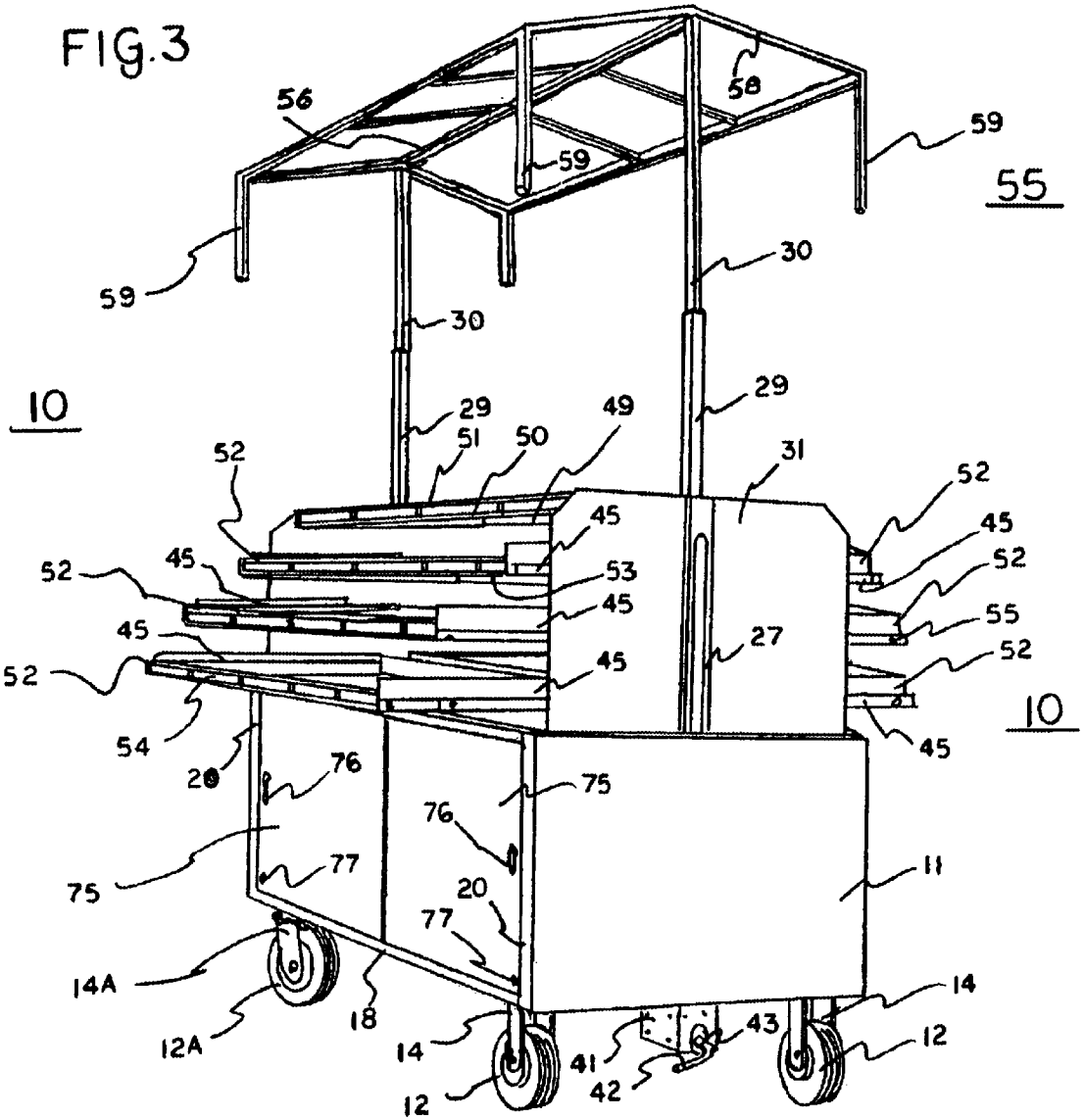
FIG. 3 is a view similar to FIG. 2, but illustrating the canopy in uncovered condition.

The fifth channel members 30 as shown in FIGS. 2, 3 are connected to a canopy frame 55 of tubular construction, which includes a header 56, a top frame 58 connected to header 56, and a plurality of vertical supports 59 connected to the top frame 58. As shown in FIG. 2, a canopy cover 57 is provided, preferably of lightweight well known fabric, which is connected to top frame 58, and supports 59. The canopy frame 55 and cover 57 as shown in FIG. 1 in the closed position extend over the outside of base 11.

The base 11 is also provided with a pair of sliding doors 75 on each side, carried between base frame 16 and upper side members 21, with handles 76 and slide locks 77, for access to base 11 as required.

When it is desired to display merchandise, or to gain access to merchandise (not shown) the gear box arm 42 is rotated counterclockwise, causing cable 62 to wind onto spool 66 and chain 37 to be moved, and through rotation of sprockets 35, 36, 38 and 39 cause channel members 27, 28, 29 and 30 to extend raising slide panels 31 and canopy frame 55, until the panels are in the upward position out of base 11, whereby drawers 52 can be extended and access had to them, and to drawers 49 as shown in FIG. 2. The arm 42 is rotated in the clockwise direction to move slide panels 31 and drawers 49 and 52 back into base 11, until the canopy 55 and cover 57 cover base 11.

It will thus be seen that structure has been provided with which the objects of the invention are achieved.

We claim:

1. A collapsible display cart for storage, transportation and display of merchandise which comprises;

a base of box like construction having a top and a bottom, and open at the top, said base including fixed end panels, a fixed vertical channel attached to each of said end panels, a plurality of vertically extendible telescoping channel members engaged with said fixed vertical channels, means for extending and retracting said channel members, a pair of slide panels attached to one of said telescoping channel members, said slide panels having a plurality of horizontal slide means attached thereto, a plurality of drawers engaged with said slide means and extending end to end in said base between said slide means, and said means for extending and retracting said channel members includes a plurality of rotatable sprockets carried by said channel members, a chain engaged with said sprockets, a cable engaged with said chain, and gear box means engaged with said cable to move said chain and said sprockets to extend and retract said channel members, for moving said drawers up and out of said base for display of merchandise.

2. A collapsible display cart as defined in claim 1 in which, said cart base is provided with at least one pair of wheels thereon for supporting and moving said cart.

3. A collapsible display cart as defined in claim 1 in which, a canopy frame is provided attached to said topmost one of said telescoping channel members, and a canopy cover is attached to said frame, movable vertically, and which covers said base in retracted closed condition.

4. A collapsible display cart as defined in claim 1 in which, said drawers are provided with bottoms and open curb members along the front and rear of said drawers.

5. A collapsible display cart as defined in claim 1 in which, said base is provided with at least one pair of slidable doors on each side for access thereinto.

6. A collapsible display cart as defined in claim 1 in which, said gear box means includes a torque limiter to prevent overwinding of said cable.

* * * * *